US006217672B1

(12) United States Patent
Zhang

(10) Patent No.: US 6,217,672 B1
(45) Date of Patent: Apr. 17, 2001

(54) MAGNETIC ANNEALING OF MAGNETIC ALLOYS IN A DYNAMIC MAGNETIC FIELD

(76) Inventor: Yide Zhang, 1 Northwood Rd., #83, Storrs, CT (US) 06268

( * ) Notice: Subject to any disclaimer, the term of this patent is extended or adjusted under 35 U.S.C. 154(b) by 0 days.

(21) Appl. No.: 09/158,510

(22) Filed: Sep. 22, 1998

Related U.S. Application Data

(60) Provisional application No. 60/059,906, filed on Sep. 24, 1997.

(51) Int. Cl.[7] ..... C21D 1/04
(52) U.S. Cl. ..... 148/108
(58) Field of Search ..... 148/108

(56) References Cited

U.S. PATENT DOCUMENTS

| | | | | |
|---|---|---|---|---|
| 3,887,401 | * | 6/1975 | Hetzel | 148/121 |
| 3,963,533 | | 6/1976 | Collins | 148/108 |
| 4,312,683 | | 1/1982 | Sakakima et al. | 148/108 |
| 4,379,004 | | 4/1983 | Makino et al. | 148/108 |
| 4,473,415 | | 9/1984 | Ochiai et al. | 148/108 |
| 4,475,962 | | 10/1984 | Hayakawa et al. | 148/108 |
| 4,575,695 | | 3/1986 | Schloemann | 333/24.1 |
| 4,816,965 | | 3/1989 | Drits | 361/267 |
| 5,032,947 | | 7/1991 | Li et al. | 361/143 |

FOREIGN PATENT DOCUMENTS

| | | | |
|---|---|---|---|
| 224994 | | 7/1985 | (DE) . |
| 0 027 362 | | 4/1981 | (EP) . |
| 2088415 | | 6/1982 | (GB) . |
| 56-37609 | | 4/1981 | (JP) . |
| 57-114646 | | 7/1982 | (JP) . |
| 59-35431 | | 8/1984 | (JP) . |
| 60-46319 | * | 3/1985 | (JP) . |
| 63-219114 | * | 9/1988 | (JP) . |
| 63-290219 | | 11/1988 | (JP) . |
| 3-39415 | * | 2/1991 | (JP) . |
| 394164 | | 1/1974 | (SU) . |
| 959925 | | 9/1982 | (SU) . |
| 1027782 | | 7/1983 | (SU) . |

* cited by examiner

*Primary Examiner*—John Sheehan
(74) *Attorney, Agent, or Firm*—Richard C. Litman

(57) ABSTRACT

A method of magnetic annealing a crystalline or nanocrystalline magnetic alloy under application of a dynamic magnetic field, i.e., an external magnetic field whose direction undergoes a periodic change in a plane, at an elevated temperature, preferably in a range of from about 300° C. to about 800° C. The applied dynamic magnetic field preferably has a maximum strength in a range of from about 1 to about 1000 Oersteds and is one of a rotation magnetic field, an elliptic-polarized magnetic field, an oscillation magnetic field, and a pair of pulsed magnetic fields.

24 Claims, 5 Drawing Sheets

MAGNETIC ANNEALING OF MAGNETIC ALLOYS IN A DYNAMIC MAGNETIC FIELD

CROSS-REFERENCE TO RELATED APPLICATION

This application claims the benefit of U.S. Provisional Patent Application Ser. No. 60/059,906, filed Sep. 24, 1997.

BACKGROUND OF THE INVENTION

1. Field of the Invention

The present invention relates to a method of improving magnetic properties of soft magnetic alloys and, more particularly, to a method of annealing crystalline or nanocrystalline magnetic alloys in forms of sheet, ribbon, or thin film under application of an external magnetic field whose direction undergoes a periodic rotation, oscillation, or step-variation in a plane, referred to as a dynamic magnetic field herein, to produce a planar texture in the plane.

2. Description of Related Art

Materials exhibiting good soft magnetic properties (ferromagnetic properties) include certain crystalline alloys in forms of sheet, ribbon, or thin film (such as Permalloys) and certain alloys in forms of sheet, ribbon, or thin film that contain nanocrystalline particles. In order to produce a good soft magnetic material, the composition of the alloy has to be selected such that its magnetocrystalline anisotropy and the magnetostriction of the material are close to zero. Further improvement of soft magnetic properties includes producing a certain crystallographic texture which favors the 180° domain structure. One way to achieve the required texture is magnetic annealing, i.e., annealing the magnetic material in the presence of a magnetic field.

Consider binary transition metal alloys $A_{100-X}B_X$. For non-magnetic alloys, the populations of A-A, A-B, and B-B atomic pairs are determined by the composition of the alloy, and their spatial distribution is random. For crystalline and nanocrystalline magnetic alloys, however, during the fabrication or annealing process when the temperatures are below the Curie temperature of the material, the atomic moments are coupled by the exchange interaction thus forming domains, and then the distribution of A-A, A-B, and B-B atomic pairs in the domains become ordered due to the dipolar interaction between the magnetic atoms. This is known as directional ordering. Directional ordering leads to the occurrence of an additional induced uniaxial magnetic anisotropy with a 180° symmetry. This induced anisotropy is the major impediment for further improvement of the soft magnetic properties of crystalline and nanocrystalline alloys.

The approach currently used by manufacturers to reduce the effect of the directional order on the magnetization process is known as static magnetic annealing, i.e., annealing the material in the presence of a DC magnetic field. Under an external magnetic field, atoms in each domain will diffuse to form preferred atomic pairs with respect to the external field. Thus, a texture is established along the magnetic field direction which favors 180° domain wall structure, and the magnetization process along this direction is easier than along other directions.

There are some weaknesses in static magnetic annealing. First, the ease of a domain wall displacement in a magnetization process along the easy direction is determined by the fluctuation of anisotropy energy along the path of the domain wall displacement. If the magnitude of the anisotropy, $K_u$, is smaller, then the fluctuation of anisotropy will also be smaller. From this point of view, creating the texture with smaller directional-order-induced anisotropy is the original task. However, in the case of static magnetic annealing, the external magnetic field merely turns the direction of the directional order for different domains into a common direction (parallel to the external magnetic field) but does not reduce the magnitude of the anisotropy. This limits the improvement of magnetic properties by static magnetic annealing.

Second, the formation of the crystallographic as well as magnetic texture is due to the action of the magnetic field. Since the magnetic field is applied only in one dimension, the texture formed is one dimensional. The orientations of the 180° domain walls in the transverse directions are still random.

Third, soft magnetic alloys are often fabricated in thin sheet shape in order to reduce the eddy current loss, and the magnetization process is along the longitudinal direction of the sheet. It is important to produce a planar texture such that it makes the domain walls parallel to the sheet plane. However, the domain structure obtained by static magnetic annealing in the interior of the sheet is not so. Therefore, there is a need for new methods of improving soft magnetic properties of crystalline and nanocrystalline magnetic alloys.

The related art is represented by the following patents of interest.

U.S. Pat. No. 3,963,533, issued on Jun. 15, 1976 to James D. Collins, describes a method of applying an alternating magnetic field to a ferromagnetic material after cooling the material in liquid nitrogen. Collins does not suggest annealing crystalline or nanocrystalline magnetic alloys in a dynamic magnetic field according to the claimed invention.

U.S. Pat. No. 4,312,683, issued on Jan. 26, 1982 to Hiroshi Sakakima et al., describes a method of heat-treating amorphous alloy films having Curie temperatures higher than their crystallization temperatures in the presence of directed magnetic fields. Sakakima et al. do not suggest annealing crystalline or nanocrystalline magnetic alloys in a dynamic magnetic field according to the claimed invention.

U.S. Pat. No. 4,379,004, issued on Apr. 5, 1983 to Yoshimi Makino et al., describes a method of heat treating an amorphous magnetic alloy under an application of a magnetic field in which the direction of the applied magnetic field and the alloy are relatively rotated with respect to each other. Makino et al. do not suggest the use of an elliptic-polarized magnetic field, an oscillation magnetic field, or a pair of pulsed magnetic fields. Makino et al. do not suggest annealing crystalline or nanocrystalline magnetic alloys in a dynamic magnetic field according to the claimed invention.

U.S. Pat. No. 4,473,415, issued on Sep. 25, 1984 to Yoshitaka Ochiai et al., describes a method of heat-treating an amorphous magnetic alloy under an application of DC magnetic fields applied in two perpendicular directions. Ochiai et al. do not suggest annealing crystalline or nanocrystalline magnetic alloys in a dynamic magnetic field according to the claimed invention.

U.S. Pat. No. 4,475,962, issued on Oct. 9, 1984 to Masatoshi Hayakawa et al., describes a method of heat-treating an amorphous magnetic alloy under an application of a repetition of alternately applied first and second magnetic fields. The applied first and second magnetic fields have the same magnitude which may result in undesirable magnetic properties. Hayakawa et al. do not suggest the use of an elliptic-polarized magnetic field, an oscillation magnetic field, or a pair of pulsed magnetic fields. Hayakawa et al. do not suggest annealing crystalline or nanocrystalline magnetic alloys in a dynamic magnetic field according to the claimed invention.

U.S. Pat. No. 4,575,695, issued on Mar. 11, 1986 to Ernst F. R. A. Schloemann, describes an arrangement capable of applying a first and second magnetic fields along first and second directions. Schloemann does not suggest annealing crystalline or nanocrystalline magnetic alloys in a dynamic magnetic field according to the claimed invention.

U.S. Pat. No. 4,816,965, issued on Mar. 28, 1989 to Vladimir Drits, describes an arrangement for providing a pulsed magnetic field. Drits does not suggest annealing crystalline or nanocrystalline magnetic alloys in a dynamic magnetic field according to the claimed invention.

U.S. Pat. No. 5,032,947, issued on Jul. 16, 1991 to James C. M. Li et al., describes a method of improving magnetic devices by applying AC or pulsed current. Li et al. do riot suggest annealing crystalline or nanocrystalline magnetic alloys in a dynamic magnetic field according to the claimed invention.

European Patent document number 0 027 362, published on Apr. 22, 1981, describes a method of improving magnetic properties of a magnetic material by subjecting the material to a magnetic field while applying mechanical vibrations or a high energy corpuscular beam to it. European document '362 does not suggest annealing crystalline or nanocrystalline magnetic alloys in a dynamic magnetic field according to the claimed invention.

German Patent document number 224,994, published on Jul. 17, 1985, describes a method of reducing the magnetic impedance of a magnetic core by applying a pulsed magnetic field before and during fixing. German document '994 does not suggest annealing crystalline or nanocrystalline magnetic alloys in a dynamic magnetic field according to the claimed invention.

Great Britain Patent document number 2,088,415, published on Jun. 9, 1982, describes a method of heat-treating an amorphous magnetic alloy under an application of a magnetic field while effecting relative rotation between the magnetic field and the alloy. British document '415 does not suggest the use of an elliptic-polarized magnetic field, an oscillation magnetic field, or a pair of pulsed magnetic fields. British document '415 does not suggest annealing crystalline or nanocrystalline magnetic alloys in a dynamic magnetic field according to the claimed invention.

Japan Patent document number 56-37609, published on Apr. 11, 1981, describes a method of producing a magnetic head core material with the application of a rotating magnetic field. Japanese document '609 does not suggest annealing crystalline or nanocrystalline magnetic alloys in a dynamic magnetic field according to the claimed invention.

Japan Patent document number 57-114646, published on Jul. 16, 1982, describes a method of heat-treating an amorphous magnetic material with the application of a rotating magnetic field. Japanese document '646 does not suggest the use of an elliptic-polarized magnetic field, an oscillation magnetic field, or a pair of pulsed magnetic fields. Japanese document '646 does not suggest annealing crystalline or nanocrystalline magnetic alloys in a dynamic magnetic field according to the claimed invention.

Japan Patent document number 59-35431, published on Aug. 28, 1984, describes a method of heat-treating an amorphous ferromagnetic alloy with the application of a rotating magnetic field. Japanese document '431 does not suggest the use of an elliptic-polarized magnetic field, an oscillation magnetic field, or a pair of pulsed magnetic fields. Japanese document '431 does not suggest annealing crystalline or nanocrystalline magnetic alloys in a dynamic magnetic field according to the claimed invention.

Japan Patent document number 63-290219, published on Nov. 11, 1988, describes a method of heat-treating an amorphous magnetic material with the application of a rotating magnetic field. Japanese document '219 does not suggest annealing crystalline or nanocrystalline magnetic alloys in a dynamic magnetic field according to the claimed invention.

Soviet Union Patent document number 394,164, published on Aug. 22, 1973, describes a method of sintering metal-ceramic parts using a diverting system of two electromagnets creating crossed magnetic fields. Soviet document '164 does not suggest annealing crystalline or nanocrystalline magnetic alloys in a dynamic magnetic field according to the claimed invention.

Soviet Union Patent document number 959,925, published on Sep. 23, 1982, describes a method of applying a layer of metal powder to a base made of compact material by forming and heating, with treatment after heating by a pulsed magnetic field. Soviet document '925 does not suggest annealing crystalline or nanocrystalline magnetic alloys in a dynamic magnetic field according to the claimed invention.

Soviet Union Patent document number 1,027,782, published on Jul. 7, 1983, describes an arrangement useful in the manufacture of permanent magnets. Soviet document '782 does not suggest annealing crystalline or nanocrystalline magnetic alloys in a dynamic magnetic field according to the claimed invention.

None of the above inventions and patents, taken either singly or in combination, is seen to describe the instant invention as claimed.

SUMMARY OF THE INVENTION

The present invention is a method of magnetic annealing a crystalline or nanocrystalline magnetic alloy, where the crystalline or nanocrystalline magnetic alloy is annealed at an elevated temperature, preferably in the range of from about 300° C. to about 800° C., under application of a dynamic magnetic field, i.e. an external magnetic field whose direction undergoes a periodic change in a plane. The crystalline or nanocrystalline alloys are preferably selected from $Fe_{100-x}Ni_x$ alloys, $Fe_{100-x}Co_x$ alloys, and nanocrystalline Fe—Cu—Nb—Si—B, Fe—Cu—V—Si—B, Fe—Zr—B, Fe—Zr—N, and Fe—Co—Zr alloys made by metallurgical processing, rapid quenching processing, or atomic deposition processing. The crystalline or nanocrystalline alloys can be in forms of sheet, ribbon, or thin film. The applied dynamic magnetic field in the method of the present invention preferably has a maximum strength in the range of from about 1 to about 1000 Oersteds and a period in the range of from about 0.01 second to about 10 seconds, and is preferably selected from one of a rotation magnetic field, an elliptic-polarized magnetic field, an oscillation magnetic field, and a pair of pulsed magnetic fields.

Accordingly, it is a principal object of the invention to provide a method of annealing crystalline or nanocrystalline magnetic alloys in the presence of a dynamic magnetic field to improve their soft magnetic properties.

It is another object of the invention to provide an annealing method for a crystalline or nanocrystalline magnetic alloy in the presence of a dynamic magnetic field having a maximum strength in a range of from about 1 to about 1000 Oersteds, depending on the alloy used.

It is a further object of the invention to provide an annealing method for a crystalline or nanocrystalline magnetic alloy in the presence of an elevated temperature in a range of from about 300° C. to about 800° C., depending on the alloy used.

Still another object of the invention is to provide an annealing method for a crystalline or nanocrystalline magnetic alloy in the presence of one of a rotation magnetic field, an elliptic polarized magnetic field, an oscillation magnetic field, and a pair of alternate pulsed magnetic fields.

It is an object of the invention to provide improved elements and arrangements thereof in an annealing method for a crystalline or nanocrystalline magnetic alloy for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention will be hereinafter described in detail. In this invention a crystalline or nanocrystalline magnetic alloy is annealed at an elevated temperature, preferably in the range of from about 300° C. to about 800° C., under application of an external magnetic field whose direction undergoes a periodic change in a plane. Such a directionally varying magnetic field will be referred to as a dynamic magnetic field herein. By annealing in a dynamic magnetic field, it is possible to greatly improve the soft magnetic properties of the crystalline or nanocrystalline magnetic alloy by producing a planar texture and reducing the induced magnetic anisotropy of the crystalline or nanocrystalline magnetic alloy.

In the fabrication of soft magnetic alloys such as Fe-Ni-based and Fe—Co-based crystalline alloys, and nanocrystalline alloys, magnetic annealing is an important procedure to obtain good magnetic properties. The magnetic annealing method that manufacturers currently use is to anneal materials in the presence of a DC magnetic field. This magnetic annealing method will be referred to as static magnetic annealing herein. The role of static magnetic annealing is to form an easy-axis texture in the magnetic field direction, along which the magnetic properties are much softer than along other directions.

Under the action of a dynamic magnetic field, two directional orders are established during the annealing process in the plane of the dynamic magnetic field, thus forming a magnetic easy-plane, instead of just one easy direction. The magnetic anisotropy of the alloy in the plane will be substantially reduced, thus the 180° domain walls in the plane are more regular, thicker, and more mobile, resulting in much better magnetic properties than those obtained via static magnetic annealing.

Dynamic magnetic annealing can be used extensively in industrial processes. In principle, wherever a static magnetic field is effective to achieve an easy-axis texture in a magnetic alloy by static magnetic annealing, a dynamic magnetic field can be utilized to achieve an easy-planar texture for the same material. With the magnetic as well as structural order in more dimensions, the materials will possess better properties and offer more options to match one's needs. Several principal methods for producing dynamic magnetic fields are described below. Depending on the shape of the alloy for annealing and the heat treatment equipment, there are many ways to produce the required dynamic magnetic field, and it is easy for manufacturers to renovate their static magnetic annealing arrangements for dynamic magnetic annealing.

The present invention is particularly effective with $Fe_{100-X}Ni_X$, $Fe_{100-X}Co_X$, and nanocrystalline soft magnetic materials. However, this method can be applicable to all of the magnetic alloys which respond to magnetic annealing.

Figure 2:
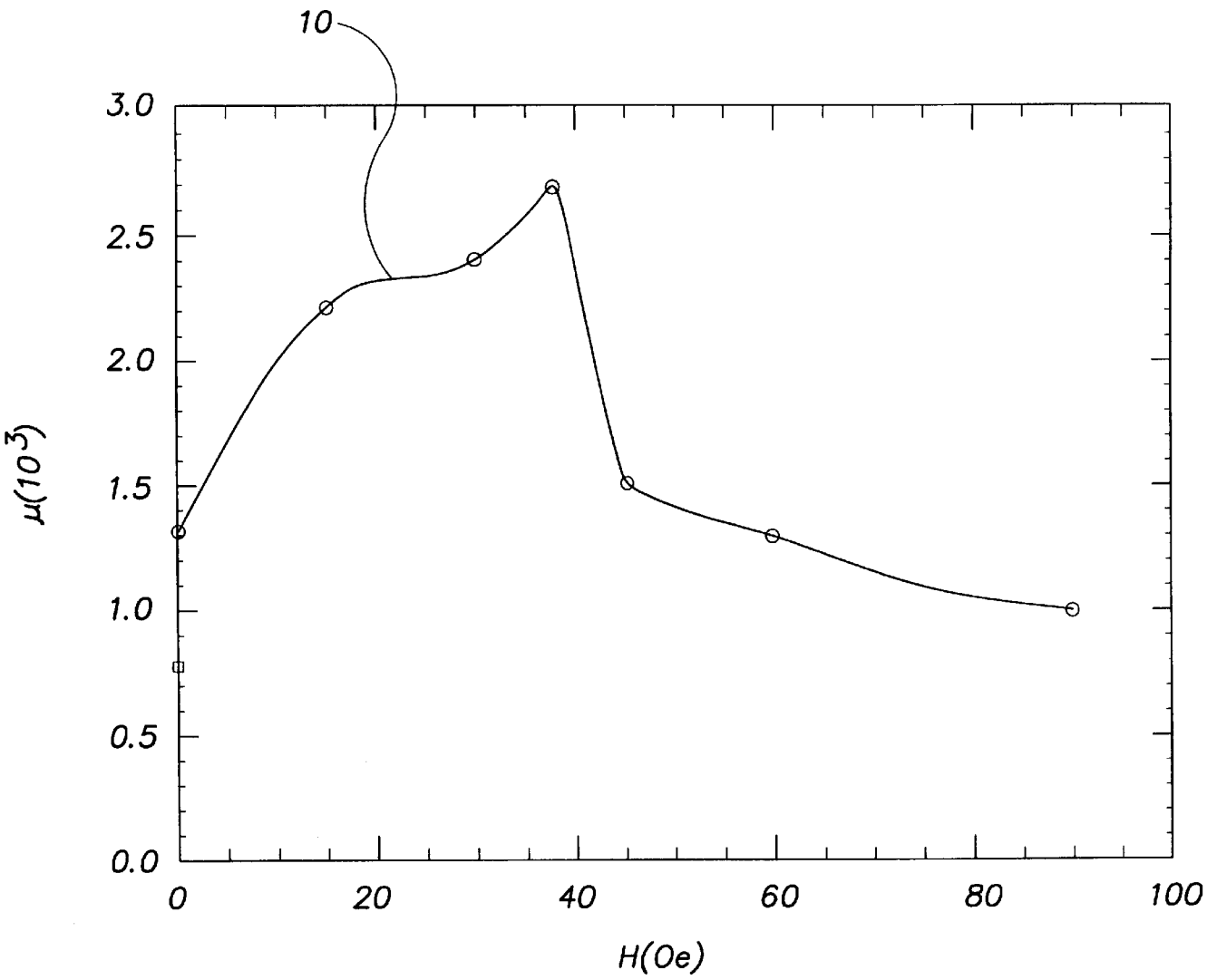
FIG. 2 is a graph showing the variation of the permeability of an Fe—Ni alloy annealed in the presence of an oscillation magnetic field.
Figure 3:
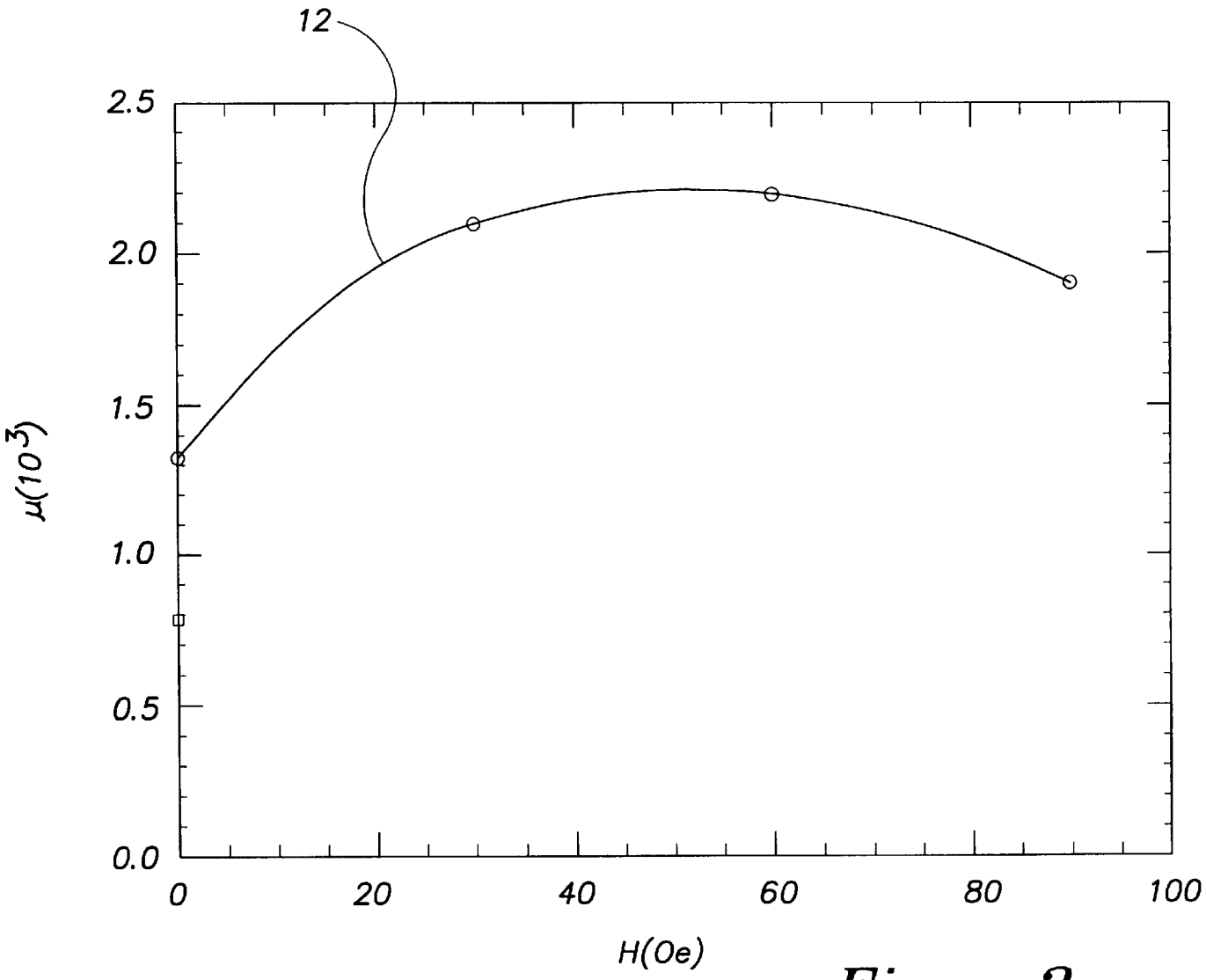
FIG. 3 is a graph showing the variation of the permeability of an Fe—Ni alloy annealed in the presence of alternate pulsed magnetic fields.
Figure 4:
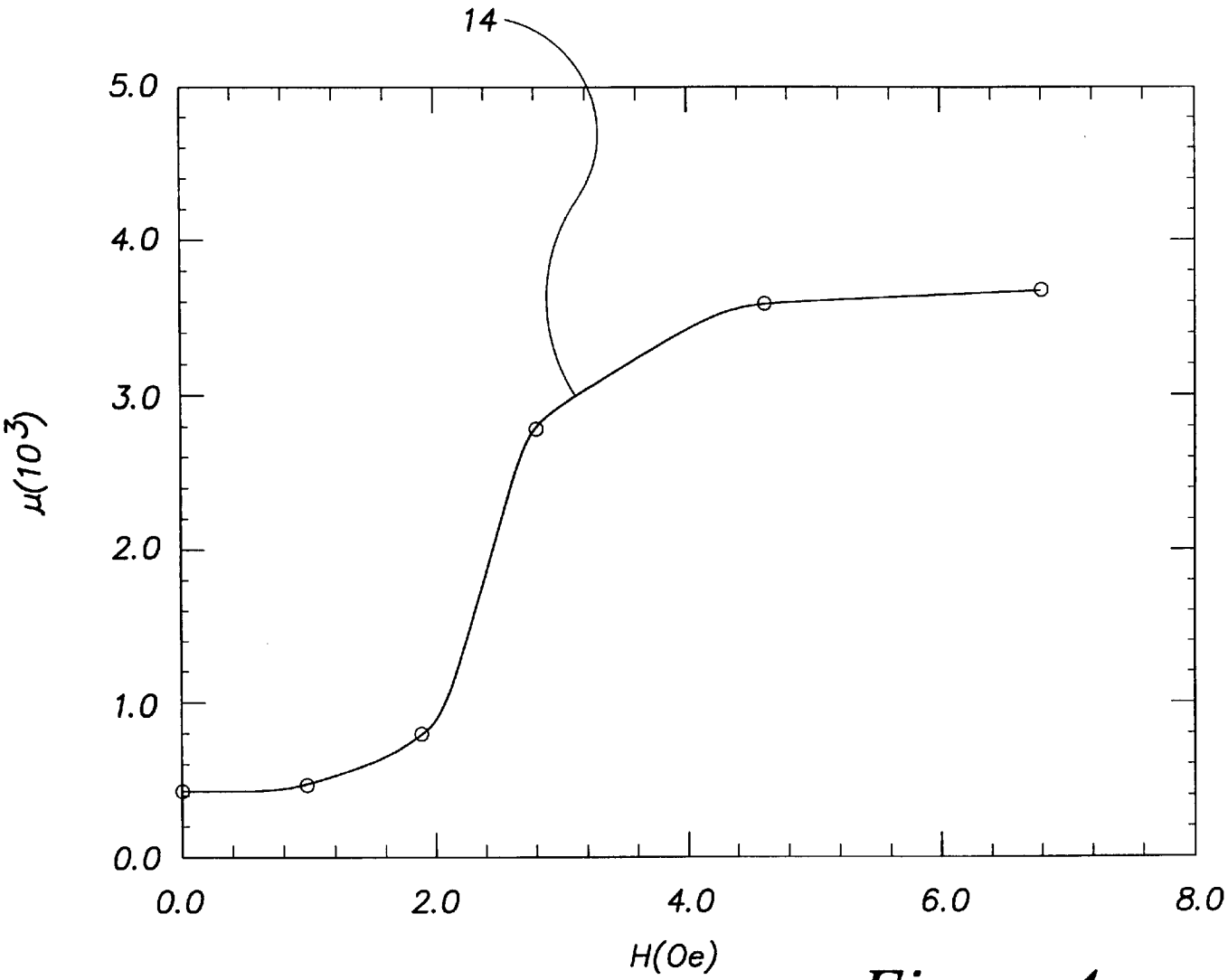
FIG. 4 is a graph showing the variation of the permeability of an Fe—Ni alloy annealed in the presence of an elliptic magnetic field.

$Fe_{100-X}Ni_X$ alloys (permalloys) with $50<x<80$ are good soft metallic magnetic alloys. They have been extensively used in a variety of AC magnetic devices. Permalloys with $x\approx78$ possess an initial permeability as high as $10^5$. The atoms in $Fe_{100-X}Ni_X$ alloys can migrate easily when the temperature reaches 450° C. or higher. The Curie temperatures for $Fe_{100-X}Ni_X$ alloys for $50<x<90$ are above 600° C. Therefore, dynamic magnetic annealing in the temperature range between 450° C. and 600° C. is effective for $Fe_{100-X}Ni_X$ alloys. When annealing $Fe_{100-X}Ni_X$ alloys in the presence of a dynamic magnetic field, as shown in FIGS. 2–4, the initial and maximum permeabilities of the $Fe_{100-X}Ni_X$ alloys are enhanced significantly.

$Fe_{100-X}Co_X$ alloys have the largest known saturation magnetization (24500 G at room temperature for $Fe_{65}Co_{35}$), the highest Curie temperature (986° C. for $Fe_{50}Co_{50}$), and high permeability ($10^5$ for $Fe_{49}Co_{49}V_2$). Since these alloys are expensive compared to $Fe_{100-X}Ni_X$ alloys, the improvement of magnetic properties will be valuable. Similar to $Fe_{100-X}Ni_X$ alloys, dynamic annealing will greatly improve the magnetic properties of $Fe_{100-X}Co_X$ alloys.

Nanocrystalline Fe—Cu—Nb—Si—B, Fe—Cu—V—Si—B, Fe—Zr—B, Fe—Zr—N, and Fe—Co—Zr alloys are recently developed new soft magnetic materials. These nanocrystalline alloys are obtained from Fe-based metallic classes by an appropriate partial crystallization process at 500–600° C., resulting in ultrafine α-Fe particles (10–50 nm) homogeneously embedded in the residual amorphous matrix, with the crystallized phase in dominance. Dynamic magnetic annealing is effective in greatly improving the magnetic properties of these alloys.

Crystalline Fe—Ni or Fe—Co based thin films and nanocrystalline Fe—Cu—Nb—Si—B, Fe—Cu—V—Si—B, Fe—Zr—N, Fe—Zr—B, and Fe—Co—Zr thin films are newly developed soft magnetic materials for applications in electronic devices, especially at high frequencies. These films are obtained by atomic deposition followed by annealing at temperatures ranging from 300° C. to about 700° C. Dynamic magnetic annealing is effective in greatly improving the soft magnetic properties of these thin films.

There are a variety of ways to produce dynamic magnetic fields. This invention provides four types of dynamic magnetic fields including a rotation magnetic field, an elliptic-polarized magnetic field, an oscillation magnetic field, and a pair of pulsed magnetic fields. Preferably, the dynamic magnetic field used in the annealing method of the present invention has a maximum strength in the range of from about 1 to about 1000 Oersteds and a period in the range of from about 0.01 second to 10 seconds.

A rotation magnetic field is a magnetic field whose direction is subject to a circularly periodic rotation. For an alloy possessing sheet or thin film shape, this rotation magnetic field can be produced by two pairs of Helmholtz coils placed such that their two axes are perpendicular to each other in the sample plane, with each pair carrying a sine-wave AC current such that the two AC currents have the same amplitude and frequency but a 90° phase shift with respect to each other. A rotation magnetic field can also be established via a physical rotation of the sheet or thin film in a DC magnet or the rotation of the DC magnet around the sheet or thin film.

An elliptic-polarized magnetic field is a rotation magnetic field with its magnitude affecting periodic change in the rotation plane. This magnetic field can be produced by the above two pairs of Helmholtz coils carrying sine-wave AC currents with different amplitudes.

Instead of using a circularly rotating magnetic field, a dynamic magnetic field can be achieved by using an oscillation magnetic field, i.e., a magnetic field whose direction oscillates back and forth within a certain angle in the strip plane. In the case of Helmholtz coil pairs as described above, an oscillation magnetic field can be produced by conducting an AC current through one Helmholtz coil pair and conducting a DC current through the other Helmholtz coil pair. Also, the oscillation magnetic field can be established via a relative physical oscillation between the sheet or thin film and magnet within a certain angle.

A dynamic magnetic field can also be achieved by alternately applying two pulsed magnetic fields which differ in direction by 90° . When the period of the pulsed magnetic fields are shorter than the diffusion relaxation time of the atoms in the alloy, the role of the two pulsed fields are equivalent to two static magnetic fields simultaneously acting on the sample, then the preferential atomic pairs will be established along both field directions, thus forming a plane with two easy directions in the plane. The pulsed magnetic field can be produced by delivering pulsed currents to the above mentioned Helmholtz coil pairs, or by a step oscillation of the sheet or thin film or magnet relative to each other.

Figure 5:
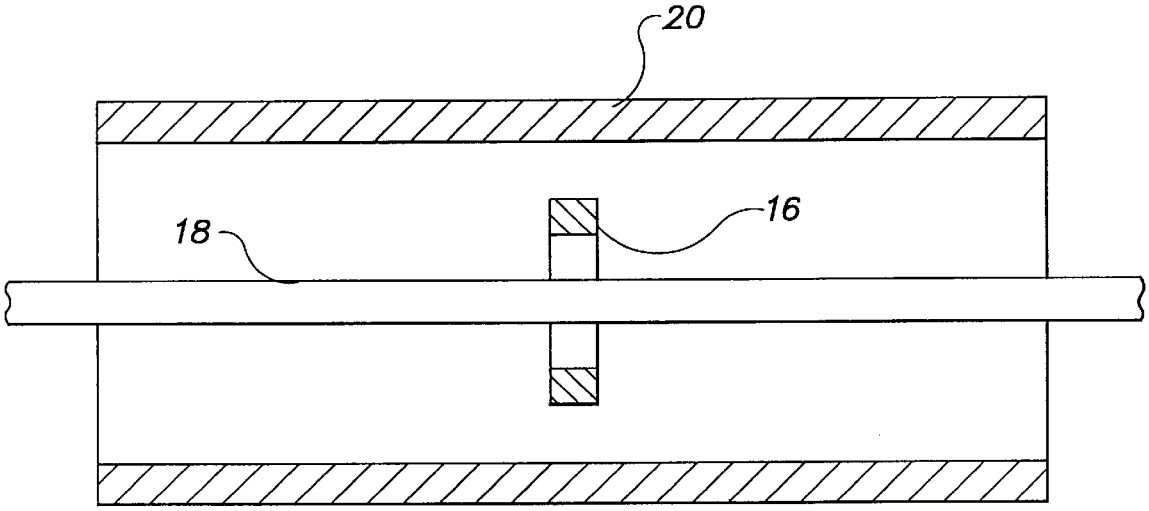
FIG. 5 is a cross-sectional view of an arrangement for generating a dynamic magnetic field in a toroidal core utilizing a a conductor rod and a solenoid.

In the majority of cases of applications, alloy ribbons are cut and wrapped to form toroidal cores, as shown in FIG. 5. For this shape, a current flowing in a conductor rod 18 placed along the axis of a toroidal core 16 produces a circular magnetic field, which is along the longitudinal direction of the toroidal core 16, while a solenoid 20 or a Helmholtz pair with their axes coincident with the axis of the toroidal core 16 produces a magnetic field along the transverse direction of the toroidal core. Manufacturers currently use this setup to perform static longitudinal or transverse magnetic annealing. The dynamic magnetic fields needed for dynamic magnetic annealing can be easily produced by using the same setup but replacing the DC current sources with pulsed current sources as follows. A rotation or elliptic-polarized magnetic field in the ribbon plane can be produced by conducting two sine-wave currents into the conductor rod and the solenoid or Helmoltz pair, respectively. The two currents should possess a 90° phase shift relative to each other. By changing the relative amplitudes of the two currents, either a rotation magnetic field or an elliptic-polarized magnetic field can be produced. An oscillation magnetic field in the ribbon plane can be produced using the above mentioned setup by conducting a DC current through the conductor rod and conducting an AC current through the solenoid or Helmoltz pair, or vice versa, by conducting a DC current through the solenoid or Helmoltz pair and an AC current through the conductor rod. Alternate pulsed magnetic fields in the ribbon plane can be produced using the same setup by alternately conducting two pulsed currents into the conductor rod and the solenoid or Helmholtz pair.

Figure 1:
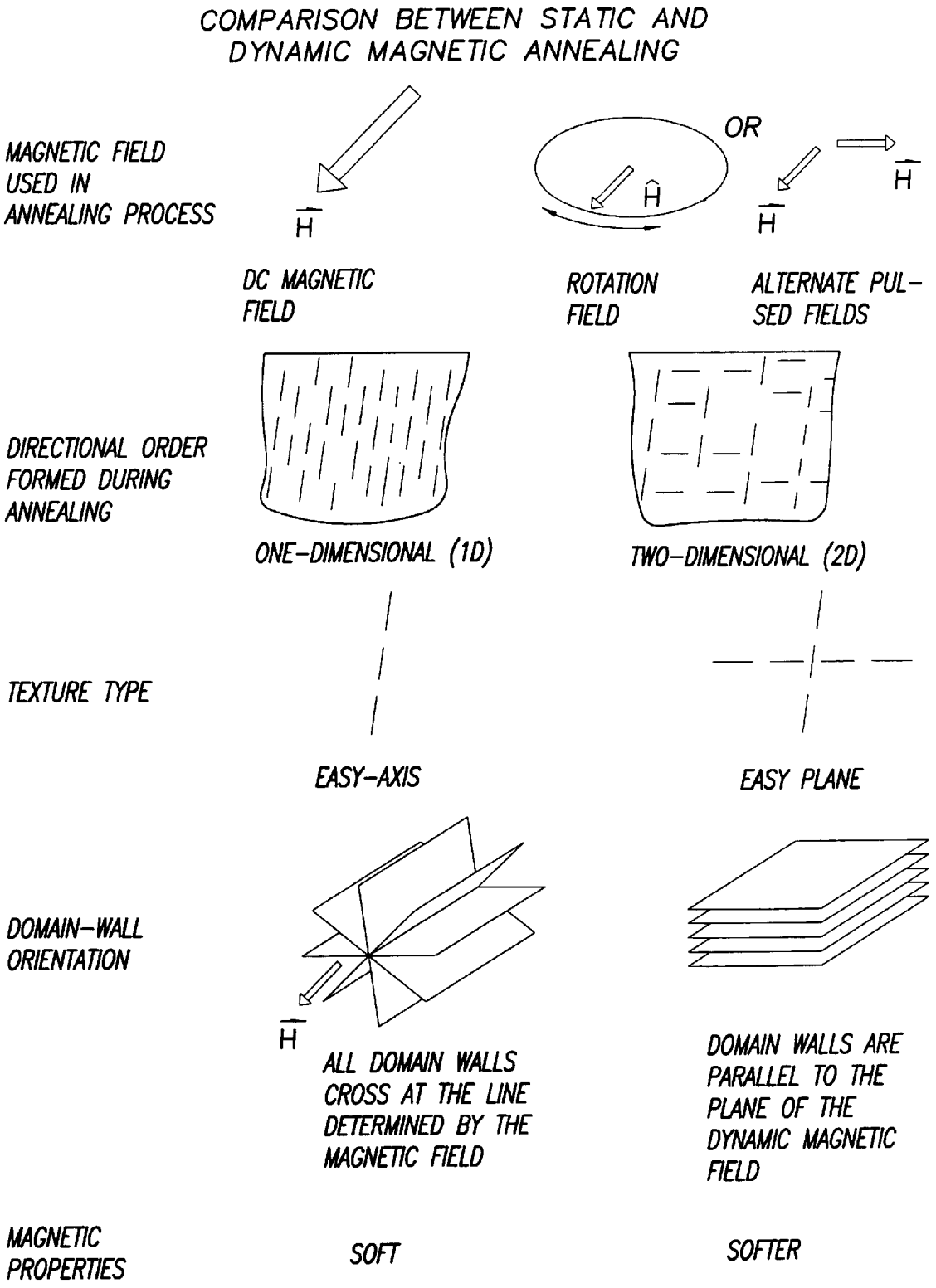
FIG. 1 is a diagrammatic representation of the comparison between the effects of static and dynamic magnetic annealing.

A large improvement of magnetic properties is achieved by dynamic magnetic annealing. FIG. 1 shows a comparison between the effects of static and dynamic magnetic annealing. After dynamic magnetic annealing, a magnetic easy-plane is established, which preserves as a preferential plane for domain walls so that a more regular 180° domain texture can be created throughout the whole volume of the material with the domain walls parallel to the sheet, ribbon, or thin film plane. In comparison with the uniaxial anisotropy produced by static magnetic annealing, the magnetization experiences a much smaller $K_u$ in the plane. This corresponds to a smaller fluctuation of the domain wall energy and, hence, better magnetic properties. With a smaller anisotropy constant, the larger inhomogeneities. All of these improvements are in favor of soft magnetic properties. In comparison with the above mentioned patents of dynamic magnetic annealing, the differences between the present invention and the previous patents and the advantages of the present invention over the previous patents are as follows:

1. As mentioned above, the previous patents of dynamic magnetic annealing are for annealing amorphous magnetic alloys, while the present invention is for annealing crystalline and nano-crystalline magnetic materials.

2. The magnetic properties of the annealed alloys depend strongly on the type of dynamic magnetic field. All except one previous patent suggest the use of a rotation magnetic field in annealing.

However, when using a rotation magnetic field or a pair of pulsed magnetic fields with the same magnitudes when annealing, the magnetic properties of the material are isotropic in the plane. It is sometimes desirable in industry to achieve anisotropic magnetic properties in the strip, ribbon, or thin film plane. This goal cannot be realized by annealing the material in a rotation magnetic field as the previous inventions suggested. The present invention provides six types of dynamic fields to serve different demands. For example, by annealing the material in an elliptic-polarized magnetic field, an oscillation magnetic field, or pulsed magnetic fields with different magnitudes in two directions, anisotropic magnetic properties can be achieved.

3. In previous inventions, the rotation field is produced through a physical rotation of the sample relative to a DC magnetic field. This is hard to practically use in industry. The present invention provides methods of producing a rotation magnetic field, an elliptic-magnetic field, an oscillation magnetic field, and a pair of pulsed magnetic fields by combining AC and AC currents, or by combining AC and DC currents. These methods are suitable for different shapes of materials, including strip, thin film, and toroidal core. These designs are easy to use in industry.

The following examples demonstrate the effectiveness of dynamic magnetic fields. Fe—Ni alloy ribbons were cut and wrapped into toroidal cores each having an outer diameter of 14 mm, an inner diameter of 10 mm, and a height of 4 mm. These Fe—Ni alloy samples were subjected to heat-treatment in $N_2$ atmosphere under different types of dynamic magnetic fields. The permeability for each Fe—Ni alloy sample was measured using an AC impedance bridge at 1.0 kHz.

A set of the Fe—Ni alloy samples were heat-treated at 670° C. for one hour in the presence of an oscillation magnetic field produced by conducting a 40 ampere DC current through a conductor rod placed along the toroidal core axis and conducting an AC current into a solenoid whose axis is coincident with the core axis. By changing the amplitude of the AC current, the oscillation angle is changed. FIG. 2 is a graph showing the variation of the permeability of an Fe—Ni alloy annealed in the presence of an oscillation magnetic field. Note that due to the magnetizing factor, the effective transverse magnetic field in the sample is much smaller that the external field produced by the solenoid. As shown in FIG. 2, the permeability of an Fe—Ni alloy sample annealed at about 670° C. without any magnetic fields is about 700, the permeability of the Fe—Ni alloy sample annealed at about 670° C. with only a static longitudinal field increases to about 1300, while the permeability of the Fe—Ni alloy sample annealed at about 670° C. in the presence of an oscillation magnetic field increases to about 2800.

A set of the Fe—Ni alloy samples were heat treated at 670° C. for one hour in the presence of alternate pulsed magnetic fields produced by alternately conducting a 60 ampere pulsed current through the above described conductor rod and conducting a magnitude-variable pulsed current through the above described solenoid. The period for each pulsed field was 0.5 second. The result is shown in FIG. 3, indicating a similar enhancement of the permeability of an Fe—Ni alloy as a function of applied alternate pulsed magnetic fields.

A set of the Fe—Ni alloy samples were heat treated at 670° C. for one hour in the presence of an elliptic-polarized magnetic field produced by conducting a sine-wave AC current through the above described conductor rod and conducting a sine-wave AC current through the above described solenoid. There was a phase shift of about 90° between the two AC currents. During the experiment, the ratio of the longitudinal magnetic field to the external transverse magnetic field was maintained at 0.2. FIG. 4 shows the permeability of an Fe—Ni alloy as a function of an applied longitudinal magnetic field. It can be seen that almost a ten times increase in permeability is obtained by the dynamic magnetic annealing.

It is to be understood that the present invention is not limited to the embodiments described above, but encompasses any and all embodiments within the scope of the following claims.

I claim:

1. Annealing method for a crystalline or nanocrystalline magnetic alloy in the form of a sheet, a ribbon, or a thin film having a plane, or a toroidal core having an axis, said annealing method comprising the steps of:

(a) preparing a crystalline or nanocrystalline magnetic alloy, the crystalline magnetic alloy and the nanocrystalline magnetic alloy being selected from the group consisting of $Fe_{100-x}Ni_x$, wherein $50<x<80$, $Fe_{100-x^1}Co_{x^1}$, wherein $0<x^1<100$, Fe—Cu—Nb—Si—B, Fe—Cu—V—Si—B, Fe—Zr—B, Fe—Zr—N and Fe—Co—Zr alloys;

(b) annealing said crystalline or nanocrystalline magnetic alloy at an elevated temperature under an application of a dynamic magnetic field to produce an easy-planar texture in said crystalline or nanocrystalline alloy.

2. In the annealing method for a crystalline or nanocrystalline magnetic alloy as set forth in claim 1, further comprising the step of providing said elevated temperature in a range of from about 300° C. to about 800° C.

3. In the annealing method for a crystalline or nanocrystalline magnetic alloy as set forth in claim 1, further comprising the step of providing said dynamic magnetic field with a maximum strength in a range of from about 1 to about 1000 Oersteds.

4. In the annealing method for a crystalline or nanocrystalline magnetic alloy as set forth in claim 1, further comprising the step of producing said dynamic magnetic field by generating a rotation magnetic field with two AC magnetic fields in the sheet, ribbon, or thin film plane of the crystalline or nanocrystalline magnetic alloy, wherein the two AC magnetic fields have the same frequencies, have the same amplitudes, and possess a 90° phase shift with respect to each other.

5. In the annealing method for a crystalline or nanocrystalline magnetic alloy as set forth in claim 1, further comprising the step of producing said dynamic magnetic field by generating a rotation magnetic field in the toroidal core by conducting a first AC current through a conductor rod placed along the axis of the toroidal core and conducting a second AC current through a solenoid having an axis in which the toroidal core is placed such that the axes of the solenoid and the toroidal core are parallel to each other, wherein the two AC currents have the same frequencies, have the same amplitudes, and possess a 90° phase shift relative to each other.

6. In the annealing method for a crystalline or nanocrystalline magnetic alloy as set forth in claim 1, further comprising the step of producing said dynamic magnetic field by generating an elliptic-polarized magnetic field with two AC magnetic fields in the sheet, ribbon, or thin film plane of the crystalline or nanocrystalline magnetic alloy, wherein the two AC magnetic fields are perpendicular to each other, have the same frequencies, have different amplitudes, and possess a 90° phase shift with respect to each other.

7. In the annealing method for a crystalline or nanocrystalline magnetic alloy as set forth in claim 1, further comprising the step of producing said dynamic magnetic field by generating an elliptic-polarized magnetic field in the toroidal core by conducting a first AC current through a conductor rod placed along the axis of the toroidal core and conducting a second AC current through a solenoid in which the toroidal core is placed, such that the axes of the solenoid and the toroidal core are parallel to each other, wherein the two AC currents have the same frequencies, have different amplitudes, and possess a 90° phase shift with respect to each other.

8. In the annealing method for a crystalline or nanocrystalline magnetic alloy as set forth in claim 1, further comprising the step of producing said dynamic magnetic field by generating an oscillation magnetic field with a DC magnetic field and an AC magnetic field in the sheet, ribbon, or thin film plane in the crystalline or nanocrystalline magnetic alloy, wherein the DC magnetic and AC magnetic fields are perpendicular to each other.

9. In the annealing method for a crystalline or nanocrystalline magnetic alloy as set forth in claim 1, further comprising the step of producing said dynamic magnetic field by generating an oscillation magnetic field in the toroidal core having an axis by conducting a first current through a conductor rod placed along the axis of the toroidal core and conducting a second current through a solenoid having an axis in which the toroidal core is placed such that the axes of the solenoid and the toroidal core are parallel to each other, wherein one of the first and second currents is AC current and the other current is DC current.

10. In the annealing method for a crystalline or nanocrystalline magnetic alloy as set forth in claim 1, further comprising the step of producing said dynamic magnetic field by generating two pulsed magnetic fields having the same magnitudes in two directions.

11. In the annealing method for a crystalline or nanocrystalline magnetic alloy as set forth in claim 1, further comprising the step of producing said dynamic magnetic field by generating two pulsed magnetic fields having different magnitudes in two directions.

12. In the annealing method for a crystalline or nanocrystalline magnetic alloy as set forth in claim 1, further comprising the step of producing said dynamic magnetic field in the toroidal core by generating two alternately pulsed magnetic fields in two directions by alternately conducting a pulsed current through a conductor rod placed along an axis of a toroidal core and conducting a pulsed current through a solenoid having an axis in which the toroidal core is placed such that the axes of the solenoid and the toroidal core are parallel to each other.

13. Annealing method for a crystalline or nanocrystalline magnetic alloy in the form of a sheet, a ribbon, or a thin film having a plane, or a toroidal core having an axis, comprising the steps of:

(a) preparing a crystalline or nanocrystalline magnetic alloy, the crystalline magnetic alloy and the nanocrystalline magnetic alloy being selected from the group consisting of $Fe_{100-x}Ni_x$, wherein $50<x<80$, $Fe_{100-x^1}Co_{x^1}$, wherein $0<x^1<100$, Fe—Cu—Nb—Si—B, Fe—Cu—V—Si—B, Fe—Zr—B, Fe—Zr—N and Fe—Co—Zr alloys;

(b) annealing said crystalline or nanocrystalline magnetic alloy at an elevated temperature under an application of a dynamic magnetic field to produce a planar texture in said crystalline or nanocrystalline alloy, wherein said dynamic field is produced by one of a rotation magnetic field, an elliptic-polarized magnetic field, an oscillation magnetic field, two pulsed magnetic fields having the same magnitudes in two directions, and two pulsed magnetic fields having different magnitudes in two directions.

14. In the annealing method for a crystalline or nanocrystalline magnetic alloy as set forth in claim 13, further comprising the step of providing said elevated temperature in a range of from about 300° C. to about 800° C.

15. In the annealing method for a crystalline or nanocrystalline magnetic alloy as set forth in claim 13, further comprising the step of providing said dynamic magnetic field with a maximum strength in a range of from about 1 to about 1000 Oersteds.

16. In the annealing method for a crystalline or nanocrystalline magnetic alloy as set forth in claim 13, further comprising the step of producing said dynamic magnetic field by generating a rotation magnetic field with two AC magnetic fields in the crystalline or nanocrystalline magnetic alloy, wherein the two AC magnetic fields have the same frequencies, have the same amplitudes, and possess a 90° phase shift relative to each other.

17. In the annealing method for a crystalline or nanocrystalline magnetic alloy as set forth in claim 13, further comprising the step of producing said dynamic magnetic field by generating a rotation magnetic field in the toroidal core by conducting a first AC current through a conductor rod placed along the axis of the toroidal core and conducting a second AC current through a solenoid having an axis in which the toroidal core is placed such that the axes of the solenoid and the toroidal core are parallel to each other, wherein the two AC currents have the same frequencies, have the same amplitudes, and possess a 90° phase shift relative to each other.

18. In the annealing method for a crystalline or nanocrystalline magnetic alloy as set forth in claim 13, further comprising the step of producing said dynamic magnetic field by generating an elliptic-polarized magnetic field with two AC magnetic fields in the sheet, ribbon, or thin film plane in the crystalline or nanocrystalline magnetic alloy, wherein the two AC magnetic fields are perpendicular to each other, have the same frequencies, have different amplitudes, and possess a 90° phase shift with respect to each other.

19. In the annealing method for a crystalline or nanocrystalline magnetic alloy as set forth in claim 13, further comprising the step of producing said dynamic magnetic field by generating an elliptic-polarized magnetic field in the toroidal core by conducting a first AC current through a conductor rod placed along the axis of the toroidal core and conducting a second AC current through a solenoid in which the toroidal core is placed such that the axes of the solenoid and the toroidal core are parallel to each other, wherein the two AC currents have the same frequencies, have the same amplitudes, and possess a 90° phase shift with respect to each other.

20. In the annealing method for a crystalline or nanocrystalline magnetic alloy as set forth in claim 13, further comprising the step of producing said dynamic magnetic field by generating an oscillation magnetic field with a DC magnetic field and an AC magnetic field in the sheet, ribbon, or thin film plane in the crystalline or nanocrystalline magnetic alloy, wherein the DC magnetic and AC magnetic fields are perpendicular to each other.

21. In the annealing method for a crystalline or nanocrystalline magnetic alloy as set forth in claim 13, further comprising the step of producing said dynamic magnetic field by generating an oscillation magnetic field in the toroidal core having an axis by conducting a first current through a conductor rod placed along the axis of the toroidal core and conducting a second current through a solenoid having an axis in which the toroidal core is placed such that the axes of the solenoid and the toroidal core are parallel to each other, wherein one of the first and second currents is AC current and the other current is DC current.

22. In the annealing method for a crystalline or nanocrystalline magnetic alloy as set forth in claim 13, further comprising the step of producing said dynamic magnetic field by generating two pulsed magnetic fields having the same magnitudes in two directions.

23. In the annealing method for a crystalline or nanocrystalline magnetic alloy as set forth in claim 13, further comprising the step of producing said dynamic magnetic field by generating two pulsed magnetic fields having different magnitudes in two directions.

24. In the annealing method for a crystalline or nanocrystalline magnetic alloy as set forth in claim 13, further comprising the step of producing said dynamic magnetic field in a toroidal core by generating two alternately pulsed magnetic fields in two directions by alternately conducting a pulsed current through a conductor rod placed along an axis of a toroidal core and conducting a pulsed current through a solenoid having an axis in which the toroidal core is placed such that the axes of the solenoid and the toroidal core are parallel to each other.

* * * * *